US006378426B1

(12) United States Patent
Furr, Jr. et al.

(10) Patent No.: US 6,378,426 B1
(45) Date of Patent: Apr. 30, 2002

(54) MANUALLY OPERABLE PROOFER FOR PRODUCING SAMPLE TEST PRINTINGS OF INKS AND COATINGS

(75) Inventors: Bobby Van Furr, Jr., Charlotte; William Edward Avery, Jr., Indian Trail, both of NC (US)

(73) Assignee: Harper Companies International, Charlotte, NC (US)

( * ) Notice: Subject to any disclaimer, the term of this patent is extended or adjusted under 35 U.S.C. 154(b) by 0 days.

(21) Appl. No.: 09/570,424

(22) Filed: May 12, 2000

(51) Int. Cl.[7] ..... B41F 9/00
(52) U.S. Cl. ..... 101/329; 101/328
(58) Field of Search ..... 101/329, 405, 101/328, 330, 331, 406; 401/48

(56) References Cited

U.S. PATENT DOCUMENTS

| | | | | |
|---|---|---|---|---|
| 2,763,206 A | | 9/1956 | Alessi, Jr. | 101/329 |
| 2,805,436 A | | 9/1957 | Christensen et al. | 15/132 |
| 4,301,730 A | | 11/1981 | Heurich et al. | 101/348 |
| 4,366,755 A | | 1/1983 | Yoshimura | 101/329 |
| 4,422,789 A | | 12/1983 | Charney et al. | 401/218 |
| 4,630,952 A | | 12/1986 | Elbaum | 401/48 |
| 4,817,526 A | | 4/1989 | Winston | 101/329 |
| 5,072,669 A | | 12/1991 | Weisbrod et al. | 101/142 |
| 5,255,603 A | * | 10/1993 | Sonneville et al. | 101/363 |
| 5,495,800 A | | 3/1996 | Weissbein et al. | 101/329 |
| 5,529,878 A | | 6/1996 | Menard et al. | 430/143 |
| 5,716,710 A | | 2/1998 | Kapusniak et al. | 428/423.1 |
| 5,725,988 A | | 3/1998 | Platzer | 430/162 |
| 5,738,970 A | | 4/1998 | Hsieh et al. | 430/259 |
| 5,792,588 A | | 8/1998 | Wilczak et al. | 430/253 |
| 5,824,448 A | | 10/1998 | Liu et al. | 430/143 |
| 5,840,464 A | | 11/1998 | Gigantino et al. | 403/257 |
| 5,856,061 A | | 1/1999 | Patel et al. | 430/201 |
| 5,935,759 A | | 8/1999 | Mertes et al. | 430/257 |
| 5,949,466 A | | 9/1999 | Kerr et al. | 347/213 |
| 6,010,821 A | | 1/2000 | Smith et al. | 430/273.1 |
| 6,116,158 A | * | 9/2000 | DeMoore et al. | 101/177 |

FOREIGN PATENT DOCUMENTS

| | | |
|---|---|---|
| DE | 551 947 | 5/1932 |
| EP | 0 803 773 A1 | 10/1997 |
| EP | 0 887 704 A1 | 2/1998 |
| EP | 0 892 310 A1 | 1/1999 |
| EP | 0 921 438 A1 | 6/1999 |
| WO | WO 98/08142 | 2/1998 |

OTHER PUBLICATIONS

Abstract for EP0867768 (Corresponds to "AD").

(List continued on next page.)

*Primary Examiner*—Ren Yan
*Assistant Examiner*—Kevin D. Williams
(74) *Attorney, Agent, or Firm*—Kennedy Covington Lobdell & Hickman, LLP

(57) ABSTRACT

A manually operable proofer for producing sample test printings of inks and coatings preparatory to a commercial printing operation basically comprises a frame with a spring-loaded handle, a carriage rotatably supporting a printing roll and mounted on the frame for movement between an operative position with the roll secured by the handle for printing operation and an inoperative position with the carriage and roll released by the handle to be accessible for removal for cleaning or exchange with another roll, and a doctor blade assembly urged with a predetermined force into peripheral wiping engagement with the anilox roll when in its operative position. The anilox roll preferably has multiple engraved circumferential bands for executing two or more test printings in a single operation.

17 Claims, 4 Drawing Sheets

OTHER PUBLICATIONS

Abstract for EP0744660 (Corresponds to "AA").
Abstract for JP 11024252A2.
Abstract for JP 10020486A2.
Abstract for JP 7156362A2.
Abstract for JP 104422A2.
Abstract for WO9853368 (Corresponds to "AK").
Article, "Controlling the Ink Film in Flexographic Printing" by Steve Paynter, Asian Packaging©, Feb. 1998.
Magazine Ad, "The Proof is in The Proof—Precision Proofer—A Necessity If You have A Color Computer"! American Ink Maker, Dec. 1999, p. 29; FLEXO, Dec. 1999, p. 93.

* cited by examiner

MANUALLY OPERABLE PROOFER FOR PRODUCING SAMPLE TEST PRINTINGS OF INKS AND COATINGS

BACKGROUND OF THE INVENTION

The present invention relates generally to commercial printing operations, especially such operations utilizing engraved anilox printing rolls. More particularly, the present invention relates to devices commonly referred to in the industry as"proofers" used for producing sample test printings of inks, coatings and the like preparatory to the implementation of a commercial printing operation, e.g., for determining appropriate printing roll characteristics and parameters for color selection or color matching purposes.

In conventional flexographic printing operations, it is widely recognized that the consistent delivery of a uniformly thin film of ink to the printing plate is critical to achieving consistent satisfactory print quality and, toward that end, the physical characteristics of the anilox roll largely determine the thinness and uniformity of the ink film transferred to the printing plate. Generally speaking, so long as a minimum acceptable density of ink is consistently maintained, it is desirable that the ink film delivered by the anilox roll be as thin as possible in order to provide optimal contrast and print fidelity.

As is known, anilox rolls are engraved, typically either by a mechanical or a laser engraving operation, to produce an array of recesses circumferentially about the peripheral surface of the roll, commonly referred to as"cells." Somewhat overly simplified, the principal characteristics of anilox rolls which determine the thickness or thinness of the ink film are the size, shape and depth of each cell, which determine the volume of ink each cell can contain, and the relative arrangement and spacing of the cells over the peripheral roll surface, generally measured and expressed as the number of cells per linear inch of the roll surface and commonly referred to as the"line screen" of a given roll.

In view of these variables in anilox rolls which affect the results in general and the quality in particular of a printing operation, the selection of the appropriate combination of physical characteristics for an anilox roll to accomplish a given printing operation is not necessarily capable of being precisely predicted and, hence, is currently as much an art as a science in actual practice. It is accordingly commonplace to perform test printings with differing anilox rolls preparatory to setting up and implementing a commercial printing operation in order to determine and verify the optimal necessary and desirable roll characteristics, e.g., cell size and shape and line screen, particularly for color testing and matching purposes.

Because of the large size of flexographic printing presses and the anilox rolls used therein, it is difficult, expensive and impractical to perform multiple test runs at the full scale of commercial equipment. Hence, miniature hand-held manually operable devices commonly referred to as"proofers" have been developed to enable more simplified print testing runs to be performed. One example of a conventional commercially available proofing device of this type is the"Precision Proofer" marketed by Precision Proofing Company, located in West Monroe La., While these conventional proofing devices are generally satisfactory in operation at least from the standpoint that the results of such proofers are typically more accurate and reliable than the selection of anilox rolls without preliminary"proofing" tests, the known conventional proofers are still considerably less accurate and reliable than the flexographic printing industry desires and there remains an unacceptable margin for error between the results achieved with a proofer and the ultimate outcome of the commercial printing operation subsequently set up based on the use of such proofers. One of the most fundamental deficiencies of known proofers is that the miniaturized anilox rolls used therein are only mechanically engraved, which has significant physical limitations in simulating the higher line screens conventionally used in flexographic printing operations performed with laser-engraved anilox rolls. Further, even with such proofing devices, there remains the concern for the time required to exchange rolls in order to perform multiple tests. Thus, there exists a substantial need within the relevant industry for a proofer which more closely simulates a commercial printing operation and enables quicker, more precise determinations to be made in selecting an anilox roll for a commercial printing operation.

SUMMARY OF THE INVENTION

It is accordingly an objection of the present invention to provide an improved proofing device which addresses the above-described deficiencies of known conventional proofers.

Briefly summarized, the present invention addresses this objective by providing a manually operable proofer basically comprising a frame adapted for manual movement over a printable substrate with a printing roll rotatably supported from the frame for rotatably delivering an imprinting onto the substrate as the frame is moved thereover. Preferably, the printing roll is an anilox roll having an array of recessed ink-collecting cells circumferentially thereabout and, most preferably, the cells are laser engraved into the periphery of the printing roll. It is further preferred that a transfer roll be rotatably supported by the frame adjacent the printing roll for peripheral surface contact therewith, thereby to be rotated in synchronism with one another.

According to one feature of the present invention, the printing roll is rotatably supported on a carriage which is mounted on the frame for movement between an operative position wherein the printing roll is secured in a disposition for forming the imprinting on the substrate as the frame moves thereover and an inoperative position wherein the printing roll is accessible to be removable for cleaning or exchange with a substitute printing roll. More particularly, the carriage comprises spaced support walls with aligned recesses therein to respectively receive opposite ends of the printing roll. In this manner, the spaced support walls of the carriage form a cradle portion which is disposed within the frame when the carriage is in its operative position in order to retain the printing roll within the cradle portion but is exposed outwardly of the frame when the carriage is in its inoperative position for easy removal of the printing roll from the spaced recesses.

In accordance with another aspect of the present invention, a doctor blade is supported by the carriage, preferably between the spaced support walls, for peripheral engagement with the printing roll in the operative position of the carriage. A torque screw or other suitable arrangement is provided for biasing the doctor blade so as to exert a predetermined peripheral engagement force against the printing roll in its operative position. It is further preferred that the doctor blade be releasably mounted to the carriage to enable disassembly from the carriage when necessary or desirable.

According to another feature of the present invention, the printing roll is formed with at least two distinct circumferential regions or bands each formed of a differing array of ink-collecting cells, e.g., having differing cell sizes, shapes and/or line screens. In this manner, each individual operation of the proofer effectively produces at least two or more distinct sample test printings, thereby reducing the number of exchanges of printing rolls necessary to complete a proofing operation.

The frame of the proofer also preferably includes a handle for manually controlling movement of the frame and, most preferably, the handle has a retaining portion spring-biased into a first position for engagement with the carriage in its operative position for retaining the carriage therein and yieldable into a second position withdrawn from the carriage for permitting movement of the carriage into its inoperative position.

Other characteristics, features and advantages of the proofer of the present invention will be described and understood from the following disclosure of a preferred embodiment of the proofer with reference to the accompanying drawings.

DETAILED DESCRIPTION OF THE PREFERRED EMBODIMENT

Figure 1:
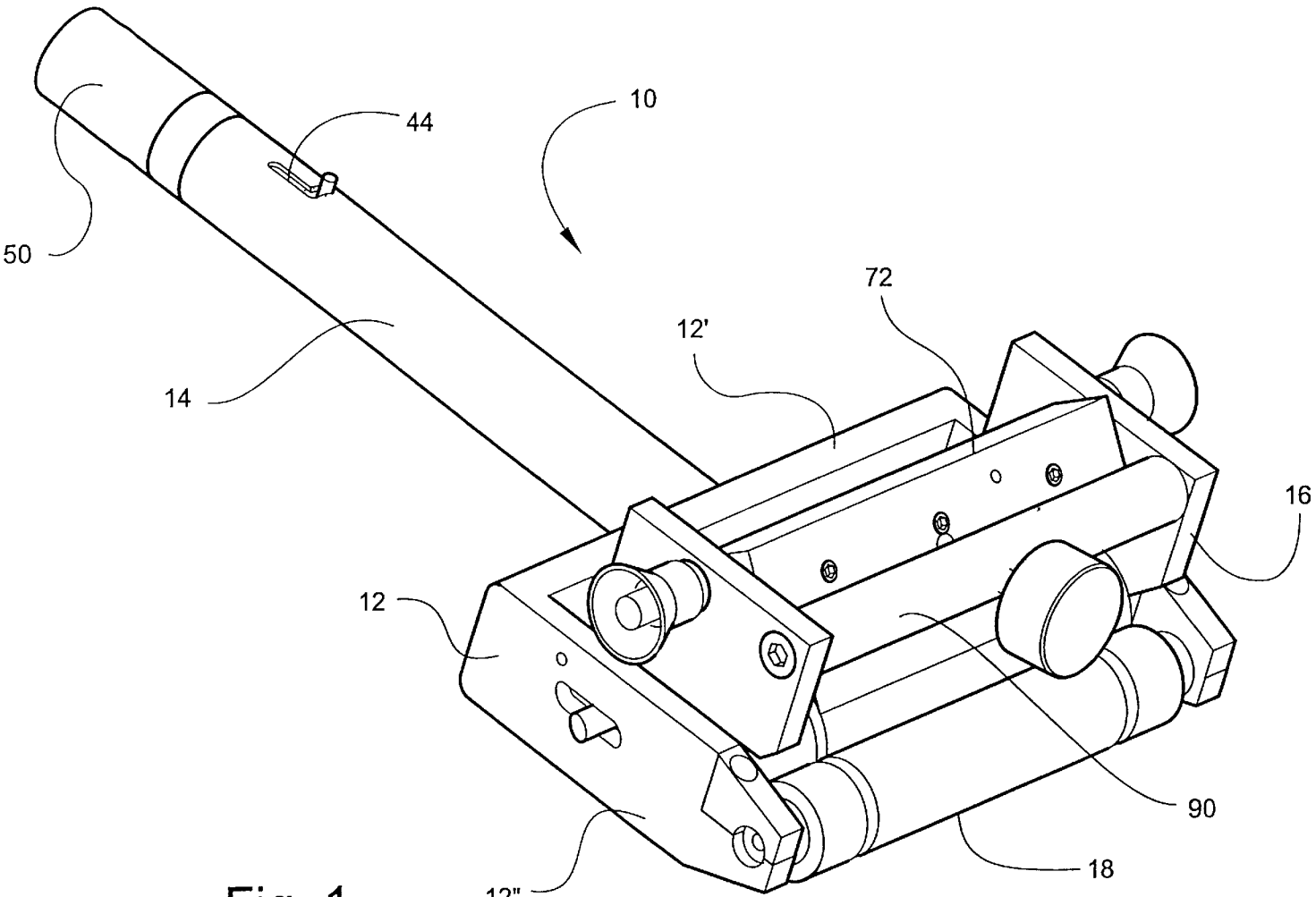
FIG. 1 is a perspective view of a proofer in accordance with a preferred embodiment of the present invention, shown in fully assembled form ready for proofing operation.

Referring now to the accompanying drawings and initially to FIG. 1, a preferred embodiment of the proofer of the present invention is shown in fully assembled form, indicated in its totality by the reference numeral 10, in which condition the proofer 10 is ready for manual operation to produce sample test printings, whether of printing inks or other coatings typically applied in a commercial printing operation. While the present invention is described herein in connection with this preferred construction of the proofer 10, it is to be understood and will be readily recognized by persons skilled in the relevant art that the proofer 10 is susceptible to a broad utility and varied applications, and may be susceptible to differing modifications, adaptations, improvements and other changes, all of which are considered to be within the overall scope of the present invention. Hence, the present invention is not to be interpreted as being limited or specific to the particular preferred construction herein described.

As shown in FIG. 1, the proofer 10 basically comprises a frame 12 in an angular U-shape forming a widthwise extending flat base 12' and a pair of spaced parallel arms 12" extending forwardly from the opposite ends of the base 12', an elongate handle assembly 14 extending rearwardly (i.e., in the opposite direction of the arms 12") from centrally along length of the base 12', and a carriage 16 mounted to the frame 12 between the arms 12" to be movable, preferably pivotable, with respect thereto and also detachable therefrom, as more fully described hereinafter.

Figure 2:
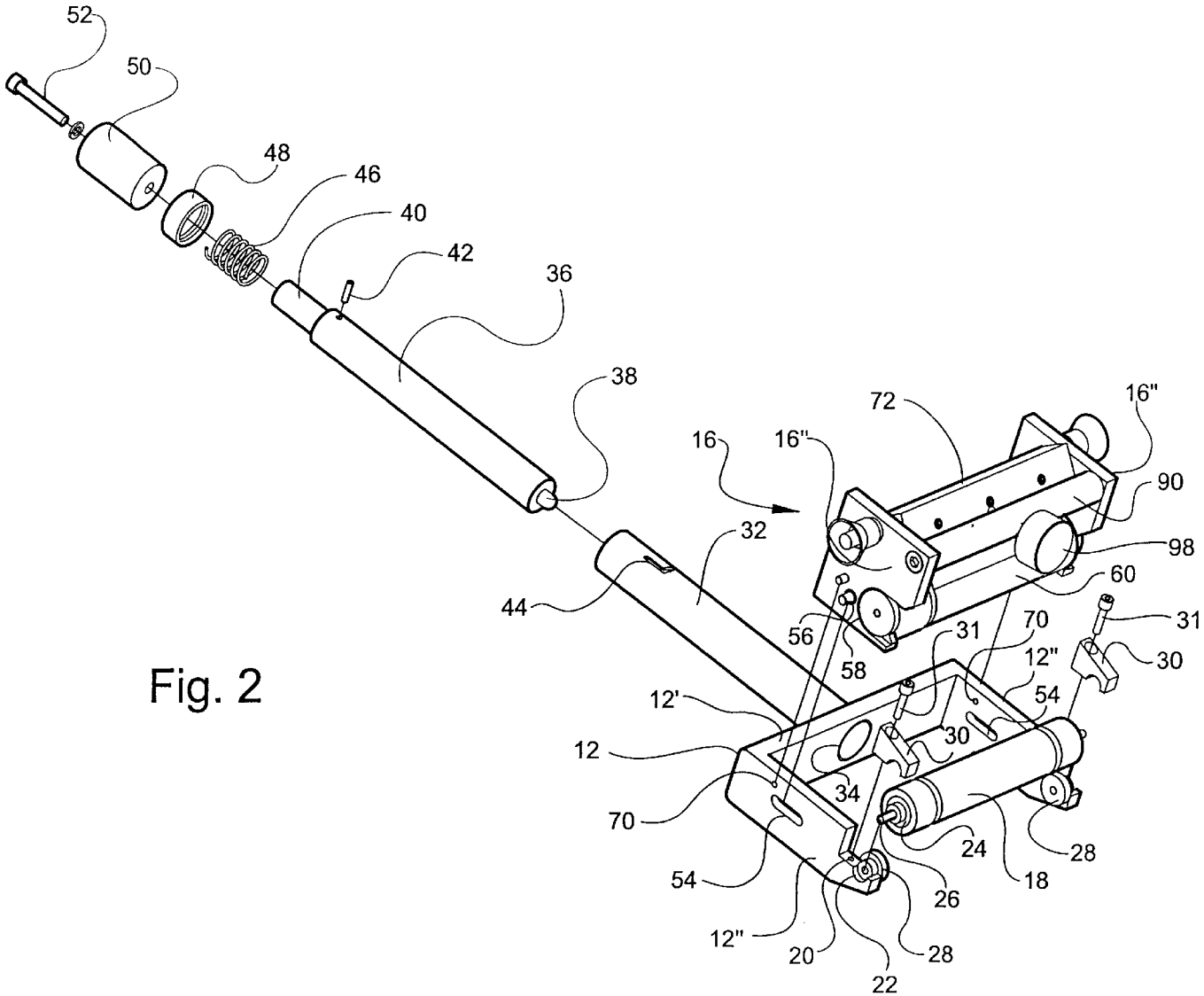
FIG. 2 is a partially exploded perspective view of the proofer of FIG. 1.

As best seen in FIG. 2, the frame 12 supports an ink/coating transfer roll 18 rotatably between the forward ends of the arms 12". More specifically, the forward ends of the frame arms 12" are recessed to form roll support shoulders 20 in each of which a semi-circular bearing recess 22 is formed. The transfer roll 18 is an elongate cylindrical roller preferably having a rubber covering or a similar relatively smooth frictional surface covering about its circumferential periphery. Roller bearings 24 are mounted within the opposite ends of the transfer roll 18, with each roller bearing 24 having an outwardly extending support shaft 26. Circular bushings 28 are supported within the semi-circular recesses 22 of the frame arms 12" and receive the bearing shafts 26 projecting from the opposite ends of the transfer roll 18, thereby to support the transfer roll 18 to be freely rotatable relative to the frame arms 12". The bushings 28, and in turn the roller bearings 24 and the transfer roll 18, are secured in such disposition on the frame arms 12" by hook-shaped retainer elements 30 affixed, e.g., by screws 31 to the support shoulders 20 in clamping relation to the bushings 28.

The handle assembly 14 comprises an elongate tubular main handle body 32 affixed within a corresponding opening 34 formed centrally within the base 12' of the frame 12. A cylindrical push rod 36 extends lengthwise within the main handle body 32, with a nose portion 38 projecting from the forward end of the push rod 36 and a reduced-diameter cylindrical end portion 40 projecting from the rearward end of the push rod 36. A dowel pin 42 projects radially from the push rod 36 outwardly through a L-shaped slot 44 in the main handle body 32 for defining a range of sliding movement of the push rod 36 within the main handle body 32 between a forward clamping position with the dowel pin 42 seated at the forwardmost end of the slot 44 toward the frame 12, wherein the nose portion 38 of the push rod 36 projects through the opening 34 into clamping engagement with the carriage 16 (as more fully described hereinafter), and a rearwardly retracted release position with the dowel pin 42 seated within the rearwardmost extent of the slot 44 away from the frame 12, wherein the nose portion 38 is withdrawn into the opening 34 away from the carriage 16.

The push rod 36 of the handle assembly 14 is spring-loaded to bias the push rod 36 into the forward clamping position. For this purpose, a coil spring 46, or other suitable spring-biasing member, is mounted about the cylindrical end portion 40 of the push rod 36 to seat against the shoulder defined between the end portion 40 and the main length of the push rod 36 and the spring 46 is retained in such disposition within the end portion of the tubular main handle body 32 by a cap 48 affixed to the rearward end of the main handle body 32. In this manner, the spring 46 tends to act between the cap 48 and the shoulder of the push rod 36 to urge the push rod 36 forwardly within the main handle body 32, subject to the limits defined by the dowel pin 42 and the L-shaped slot 44.

To facilitate linear and rotational movement of the push rod 36 within the main handle body 32 for selectively moving the push rod 36 between its forward clamping position and its rearward release position, the rearwardmost end of the cylindrical end portion 40 of the push rod 36 projects rearwardly through a corresponding opening in the cap 48 and an operating knob 50 is rigidly affixed to the exposed rearward end of the cylindrical end portion 40, e.g., by a retaining screw 52. Thus, the push rod 36 may be withdrawn into its retracted position against the biasing force of the spring 46 by exerting a manual pulling force on the knob 50 to withdraw the dowel pin 42 rearwardly within the L-shaped slot 44 and then rotating the knob 50 to seat the dowel pin 42 within the annular extent of the slot 44. By reversing the process and releasing the knob 50, the spring 46 will return the push rod 36 forwardly into its clamping position, seating the dowel pin 42 within the forwardmost end of the slot 44.

Figure 3:
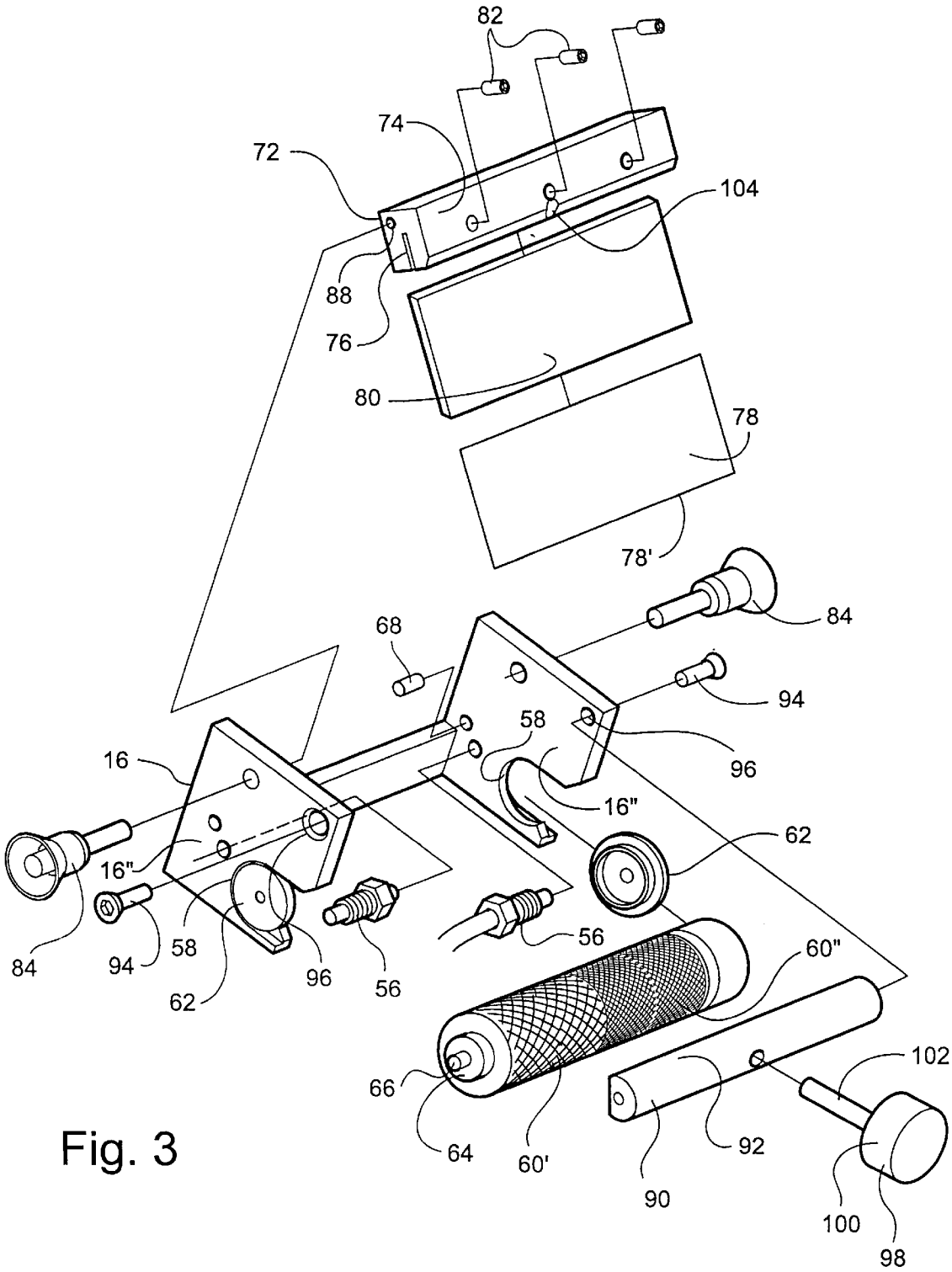
FIG. 3 is an exploded perspective view of the carriage assembly of the proofer of FIGS. 1 and 2.

As best seen in FIG. 3, the carriage 16 comprises a flat elongate base plate 16' from the opposite ends of which extend perpendicularly spaced parallel wall plates 16" to form an angular U-shaped configuration similar to that of the frame 12 but of a slightly reduced length to be received between the arms 12" of the frame 12 (see FIGS. 1 and 2). More specifically, the frame arms 12" are formed with elongate slots 54 extending in the lengthwise direction of the arms 12" in which slots 54 are received spring-loaded plungers 56 mounted to the wall plates 16" of the carriage 16. In this manner, the carriage 16 is mounted between the frame arms 12" for forward and rearward sliding movement within the slots 54 and also for pivoting movement relative to the frame arms 12".

The carriage 16 rotatably supports an anilox printing, roll 60 between the forwardmost ends of the wall plates 16". For this purpose, each of the wall plates 16" is formed with a forwardly-opening semi-circular recess 58 configured to support a bushing 62. The opposite ends of the anilox roll 60 carry rotational bearings 64, each having a projecting shaft 66 supported by a respective one of the bushings 62, whereby the anilox roll 60 is supported for free rotation relative to the carriage 16.

The carriage 16 does not itself include any element or structure to physically hold or otherwise retain the anilox roll 60 and bushings 62 within the spaced recesses 58 of the wall plates 16". Rather, when the carriage 16 is pivoted downwardly relative to the frame arms 12" into the disposition illustrated in FIG. 1 and the carriage 16 is moved forwardly within the slots 54, the anilox roll 60 is disposed in peripheral surface engagement with the transfer roll 18, thereby retaining the anilox roll 60 and the supporting bushings 62 against movement out of the recesses 58 and the wall plates 16". Within the carriage 16 in such disposition, and with the handle assembly 14 released into its forward clamping disposition, the nose portion 38 of the push rod 36 projects into engagement with the base plate 16' of the carriage 16 to exert a retaining force holding the anilox roll 60 in peripheral surface engagement with the transfer roll 18. In addition, the wall plates 16" of the carriage 16 are also provided with spring-loaded detents 68 for engagement in mating openings 70 in the frame arms 12" when the handle assembly 14 is retracted and the carriage 16 is pivoted upwardly into an inoperative disposition, as more fully described below.

The carriage 16 also supports a so-called doctor blade assembly 72 between the wall plates 16', as also seen in FIG. 3. The doctor blade assembly 72 basically comprises a mounting block 74 having a forwardly opening slot 76 in which a flat doctor blade 78 having a sharpened forward edge 78' and a similarly flat blade support plate 80 are retained by set screws 82 affixed in the mounting block 74. The mounting block 74 is supported between the wall plates 16' of the carriage 16 by a pair of quick-release spring-loaded plunger devices 84 which project inwardly through aligned openings 86 in the wall plates 16" and are seated within respective openings 88 formed in the opposite ends of the mounting block 74. In such disposition, the doctor blade assembly 72 is pivotable about the plungers 84 to position the edge 78' of the doctor blade 78 in tangential wiping engagement with the circumferential periphery of the anilox roll 60.

To retain the doctor blade assembly 72 in such operative disposition, a blade positioning unit 90 is also mounted between the wall plates 16" of the carriage 16. The blade positioning unit 90 basically comprises an elongate rod 92 extending laterally between the wall plates 16" and retained in such disposition by a pair of screws 94 extending through mated openings 96 in the wall plates 16" and into the opposite ends of the rod 92. A torque-limiting bolt assembly 98 is mounted to the rod 92 and basically comprises an actuating knob 100, a projecting shaft 102 and an internal mechanism therebetween (not shown) which acts in a conventionally known manner to exert through the shaft 102 an axial force of a predetermined limited amount. The torque-limiting bolt assembly 98 is thusly disposed for engagement of its shaft 102 within a mating recess 104 in the mounting block 74 of the doctor blade assembly 72 to apply the doctor blade edge 78' with a predetermined but limited wiping force against the periphery of the anilox roll 60, thereby to prevent excessive damaging contact between the doctor blade 78 and the anilox roll 60.

The anilox roll 60 may be of any configuration and construction as appropriate to produce any desired sample test printing. In accordance with the present invention, it is preferred that the anilox roll 60 be manufactured to the identical specifications as the full-scale anilox rolls to be used in the commercial printing operation for which the test printings are intended. Thus, for example, the anilox roll 60 may preferably be fabricated as a ceramic coated roll having ink cells laser-engraved therein to best enable the proofer 10 to simulate such rolls as are commonly utilized in conventional flexographic printing. To optimize the test printing capabilities of the proofer 10, it is further preferred that the anilox roll 60 be of a"banded" construction, i.e., formed with two or more distinct, discreet circumferential bands 60', 60" along the axial length of the roll 60, each band being engraved or otherwise formed with a differing ink cell configuration, e.g., representing different line screen counts, differing cell shapes or sizes, etc., whereby two or more test printings may be executed utilizing a single roll 60.

The operation of the proofer 10 may thus be understood. With the frame 12 and carriage 16 fully assembled with the carriage 16 in its operative disposition, the handle assembly 14 engaged with its push rod 36 in the forwardly-projecting carriage-retaining disposition, and the doctor blade assembly 72 operatively retained by the torque-limiting bolt assembly 98, the handle assembly 14 is grasped by a user and positioned at an approximately 45 degree angle on a substrate to be test printed. In such disposition, a small amount of a selected ink (e.g., approximately one teaspoon) is applied along the length of the anilox roller, e.g., by means of an eyedropper. Thereupon, the proofer 10 is manipulated via the handle assembly 14 into an approximately 20 to 30 degree disposition relative to the substrate and is pulled by the handle toward the user in a uniform motion. As a result, the contact by the transfer roll 18 with the substrate drivenly rotates the transfer roll 18 and, in turn, peripherally drives the anilox roll 60. The ink applied to the anilox roll 60 spreads essentially uniformly among the engraved cells in its peripheral surface and is transferred onto the transfer roll 18 and therefrom onto the substrate, thereby executing a test printing.

Advantageously, the spring biasing action of the handle assembly 14 maintains a uniform contact pressure between the transfer roll 18 and the anilox roll 60 and, likewise, the action of the torque-limiting bolt assembly 98 maintains a uniform wiping pressure of the doctor blade 78 against the anilox roll 60, thereby simulating as closely as reasonably possible in a manually operated unit the corresponding actions of a full-scale commercial flexographic printing machine. As an ultimate result, the quality of the test printing and, in particular, the correspondence of the test to that of a full-scale flexographic printing operation significantly exceeds the results achievable through any conventionally-known proofer device. As previously mentioned, the provision of the anilox roll 60 with multiple annular engraved bands 60', 60" advantageously enables the user to produce a corresponding number of different test printings in a single pass of the proofer 10.

Figure 4:
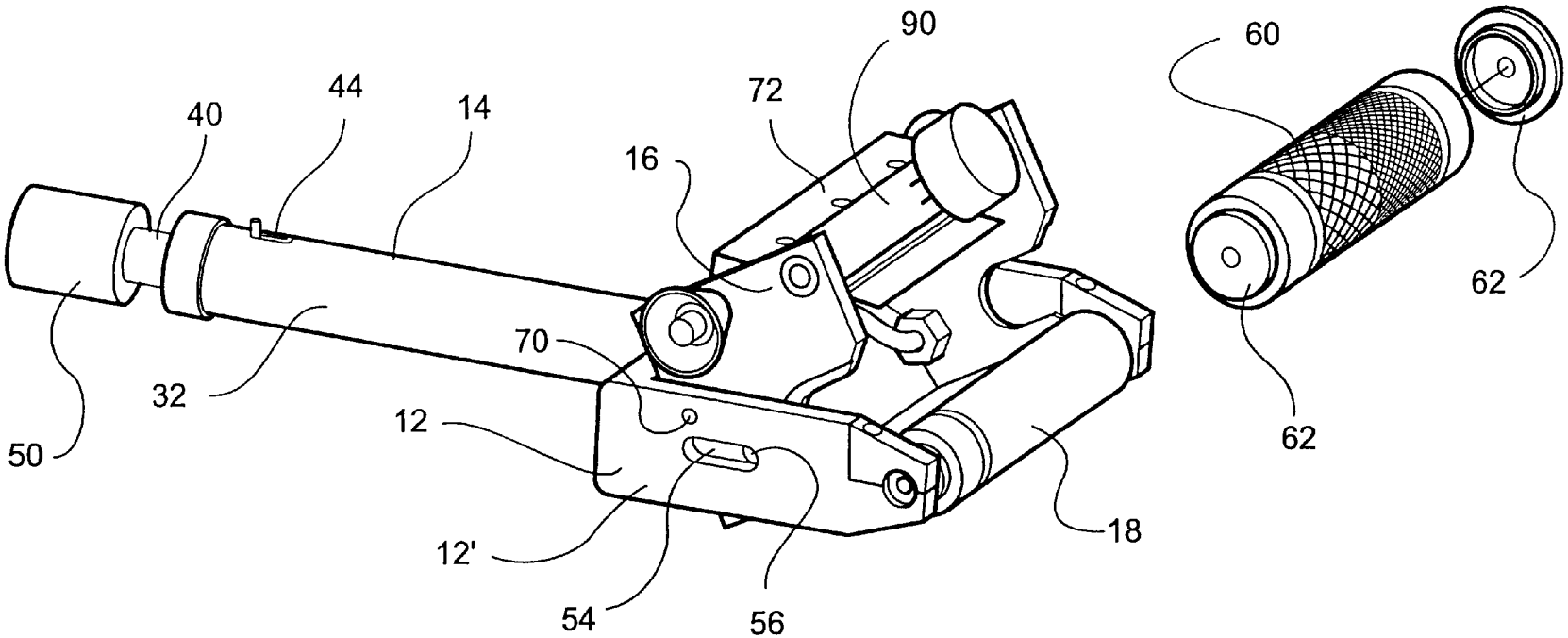
FIG. 4 is a perspective view of the proofer of FIGS. 1–3, depicting the carriage assembly pivoted into its inoperative position for installation or removal of the printing roll.

A significant additional advantage of the proofer 10 of the present invention is its ability to quickly exchange one anilox roll 60 for another. This operation is readily accomplished by first operating the handle assembly 14 via retraction and rotation of the operating knob 50 to withdraw and retain the push rod 36 in its retracted disposition out of retaining engagement with the carriage 16. The carriage assembly 16 may then be moved rearwardly away from the transfer roll 18 via sliding movement of the spring-loaded plungers 56 within the slots 54, whereupon the carriage 16 may be pivoted upwardly to expose the anilox roll 60 for easy removal from the recesses 58 in the carriage wall plates 16", as depicted in FIG. 4. The spring-loaded detents 68 advantageously engage in the openings 70 when the carriage 16 is thusly pivoted, thereby to conveniently secure the carriage 16 in this non-operating position to best facilitate removal and exchange of the anilox roll 60. In this manner, the anilox roll 60 may be quickly removed for cleaning or to be exchanged with another anilox roll, e.g., one having still further differing engraved bands 106, so as to quickly enable the user to execute additional test printings.

Operation of the actuating knob 100 of the torque-limiting bolt assembly 98 similarly enables the doctor blade assembly 72 to be quickly pivoted away from the anilox roll 60 to further simplify and facilitate removal and exchange of the roll 60. If necessary or desirable, the doctor blade assembly 72 may also be quickly removed when the carriage 16 is disposed in this inoperative disposition, by depressing the spring-loaded plunger assemblies 84 to release from the doctor blade assembly 72, whereupon the plungers 84 may be withdrawn from the carriage wall plates 16" and the doctor blade assembly 72 removed therefrom. The doctor blade assembly 72, or a replacement blade assembly, and the anilox roll 60, or a substitute roll, may be readily installed by executing the above-described steps in reverse, whereupon the carriage 16 may be pivoted back into its operative disposition and the handle assembly 14 released to re-engage into its carriage retaining position, whereupon the proofer 10 is once again ready for operation.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A manually operable proofer for producing sample test printings of inks and coatings preparatory to implementation of a commercial printing operation, the proofer comprising a frame adapted for manual movement over a printable substrate, a printing roll, and a carriage rotatably supporting the printing roll and mounted on the frame via spring-loaded plungers for translatory and pivotable movement of the carriage relative to the frame between an operative position wherein the printing roll is secured in a disposition within the frame for rotatably delivering an imprinting onto the substrate as the frame is moved thereover and an inoperative position wherein the printing roll is pivoted outwardly of the frame to be accessible to be removed for cleaning or exchange with a substitute printing roll.

2. A proofer in accordance with claim 1, wherein the carriage includes a cradle portion for insertion and removal of the printing roll, the cradle portion being disposed within the frame when the carriage is in the operative position for retaining the printing roll within the cradle portion and being exposed outwardly of the frame when the carriage is in the inoperative position for removal of the printing roll.

3. A proofer in accordance with claim 2, wherein the carriage comprises spaced support walls for supporting the printing roll therebetween.

4. A proofer in accordance with claim 3, wherein the cradle portion of the carriage comprises aligned recesses in the support walls for respectively receiving opposite ends of the printing roll.

5. A proofer in accordance with claim 3, further comprising a doctor blade supported between the support walls in peripheral engagement with the printing roll.

6. A proofer in accordance with claim 5, further comprising means for releasably mounting the doctor blade to the support walls for selective removal therefrom.

7. A proofer in accordance with claim 1, further comprising a doctor blade supported by the carriage in peripheral engagement with the printing roll.

8. A proofer in accordance with claim 7, further comprising means for biasing the doctor blade to exert a predetermined peripheral engagement force against the printing roll.

9. A proofer in accordance with claim 1, wherein the printing roll is an anilox roll having an array of recessed ink-collecting cells circumferentially thereabout.

10. A proofer in accordance with claim 9, wherein the printing roll comprises a plurality of distinct circumferential regions each of a differing array of ink-collecting cells.

11. A proofer in accordance with claim 9, where the array of cells is laser engraved into the periphery of the printing roll.

12. A proofer in accordance with claim 9, further comprising a transfer roll rotatably supported by the frame adjacent the carriage for peripheral surface contact with the printing roll in the operative position of the carriage.

13. A proofer in accordance with claim 1, wherein the frame includes a handle for manually controlling movement of the frame.

14. A proofer in accordance with claim 13, wherein the handle includes a retaining portion movable between a first position for engagement with the carriage in the operative position for retaining the carriage therein and a second position withdrawn from the carriage for permitting movement thereof into the inoperative position.

15. A proofer in accordance with claim 14, wherein the handle comprises a spring for biasing the retaining portion of the handle into the first position.

16. A proofer in accordance with claim 1, wherein the carriage includes a spring-loaded detents for securing the carriage in the inoperative position.

17. A manually operable proofer for producing sample test printings of inks and coatings preparatory to implementation of a commercial printing operation, the proofer comprising a frame adapted for manual movement over a printable substrate, a printing roll, and a carriage rotatably supporting the printing roll and mounted on the frame for translatory and pivotable movement relative thereto between an operative position wherein the printing roll is secured in a disposition within the frame for rotatably delivering an imprinting onto the substrate as the frame is moved thereover and an inoperative position wherein the printing roll is pivoted outwardly of the frame to be accessible to be removed for cleaning or exchange with a substitute printing roll, wherein the carriage includes spring-loaded detents for securing the carriage in the inoperative position.

* * * * *